United States Patent [19]

Luteran

[11] 4,115,758

[45] Sep. 19, 1978

[54] VISUAL TEST INDICATOR FOR IGNITION SYSTEMS

[76] Inventor: Frank K. Luteran, Rd. #1, Montdale, Pa. 18447

[21] Appl. No.: 570,076

[22] Filed: Apr. 21, 1975

[51] Int. Cl.[2] ..... G08B 21/00

[52] U.S. Cl. ..... 340/52 R; 340/105; 315/209 T; 123/148 E

[58] Field of Search ..... 340/52 R, 58, 59, 60, 340/79, 105; 315/209 T; 123/148 E

[56] References Cited

U.S. PATENT DOCUMENTS

| | | | |
|---|---|---|---|
| 1,172,168 | 2/1916 | Schade et al. | 340/52 R |
| 1,931,225 | 10/1933 | Heaton | 340/52 R |
| 1,983,341 | 12/1934 | Brown et al. | 340/105 |
| 3,394,690 | 7/1968 | Bell | 123/148 E |
| 3,504,230 | 3/1970 | Gaddes | 315/209 T |

*Primary Examiner*—Alvin H. Waring

[57] ABSTRACT

The proper operation of the ignition system of an internal combustion engine is determined by a visual test indicator which is built into the ignition circuitry. The indicator is energized whenever a H.V. pulse is generated in the secondary circuit. Failure of the indicator to light shows an ignition malfunction. The system is applicable to both point contact and electronic ignition systems.

8 Claims, 3 Drawing Figures

VISUAL TEST INDICATOR FOR IGNITION SYSTEMS

BACKGROUND OF THE INVENTION

This invention relates to a visual indicator for the ignition system of an internal combustion engine.

The proper operation of the ignition system in an automobile is difficult to determine without using external test equipment. In many cases where the engine fails to operate properly, the cause is usually due to other than ignition failures. Much time and effort is usually spent in first checking through the ignition system before the real problem is finally attacked.

The new electronic ignition systems although more reliable than the older systems still suffer from the lack of a built-in device to indicate proper ignition operation.

SUMMARY OF THE INVENTION

The present invention provides a visual indicator means for indicating when an ignition system is generating ignition pulses. The indicator is energized by the over-voltage generated in the primary circuit of an ignition coil whenever a H.V. is generated in the coil secondary circuit. Another function of the indicator is to clamp the primary circuit overvoltages to a predetermined maximum value, thereby preventing breakdown of semi-conductor devices incorporated in the switching circuits of the newer electronic ignition systems.

Figure 1:
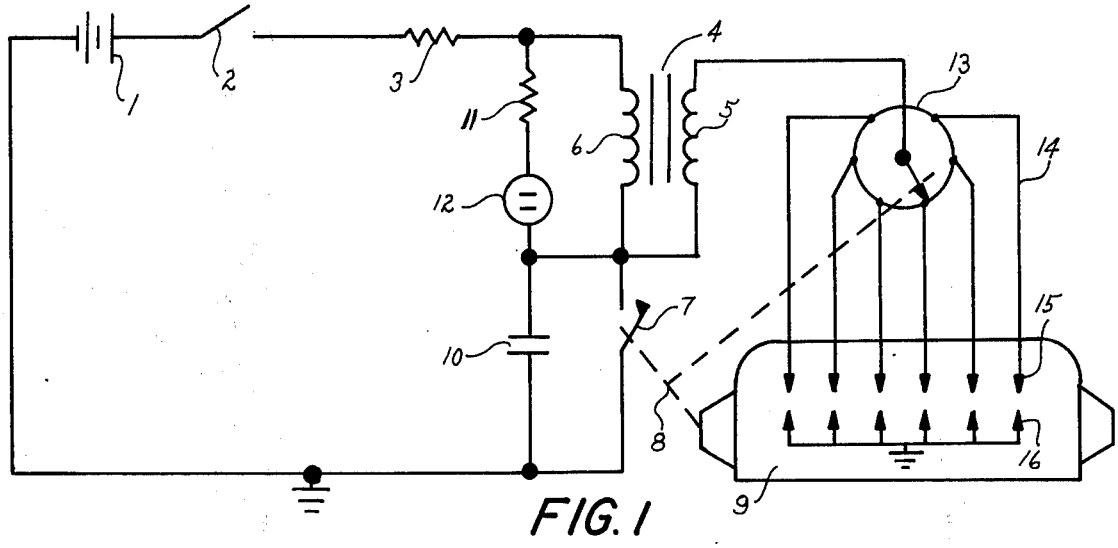
FIG. 1 is a schematic illustration of the visual indicator in a conventional point contact ignition system.

Referring now to the drawing in FIG. 1. A battery 1 provides an electrical current through the primary circuit composed of ignition switch 2 and ballast resistor 3 through primary winding 6 of ignition coil 4 and through ignition contacts 7. When ignition switch 2 is closed, the current flow through the primary circuit is determined by the position of ignition contacts 7. Contacts 7 are opened and closed in synchronization with the operation of engine 9 through mechanical linkage 8. When an ignition pulse is required by a cylinder of engine 9, contacts 7 are mechanically opened and the primary current is interrupted. Interruption of the primary current from a finite value to zero causes a H.V. ignition pulse to be generated in secondary winding 5 of ignition coil 4. The H.V. pulse is switched to the appropriate cylinder of engine 9 through distributor 13 in proper synchronization with engine 9 through mechanical linkage 8. The H.V. ignition pulse after being switched in distributor 13 is coupled through lead 14 to spark plug 15 where an arc is generated in a cylinder of engine 9 as the pulse is conducted to ground point 16. The operation of the distributor is well known in the art and therefore, will not be described in greater detail.

In the primary circuit, the opening of contacts 7 with the resultant interruption of the primary current causes an overvoltage to appear across the opened contacts 7. The overvoltage is caused by transformer action in ignition coil 4. Capacitor 10 connected in parallel with contact 7 limits the amplitude of the overvoltage and thereby reduces the arcing across contacts 7. Connected in parallel across primary winding 6 are resistor 11 in series with indicator lamp 12. Indicator lamp 12 is a type that requires a voltage greater than the voltage of battery 1 to be conductive. It may be a gas tube filled with neon or xenon. Resistor 11 limits the current flow through lamp 12 to a value that is required for lamp operation. The energization of lamp 12 occurs only when the overvoltage appears across contacts 7. An overvoltage simultaneously occurs across primary winding 6 due to the serial connection of the coil and contacts.

Each time a H.V. ignition pulse is generated, the indicator lamp is momentarily energized, thereby providing a visual indication that ignition pulse generation is occurring.

Figure 2:
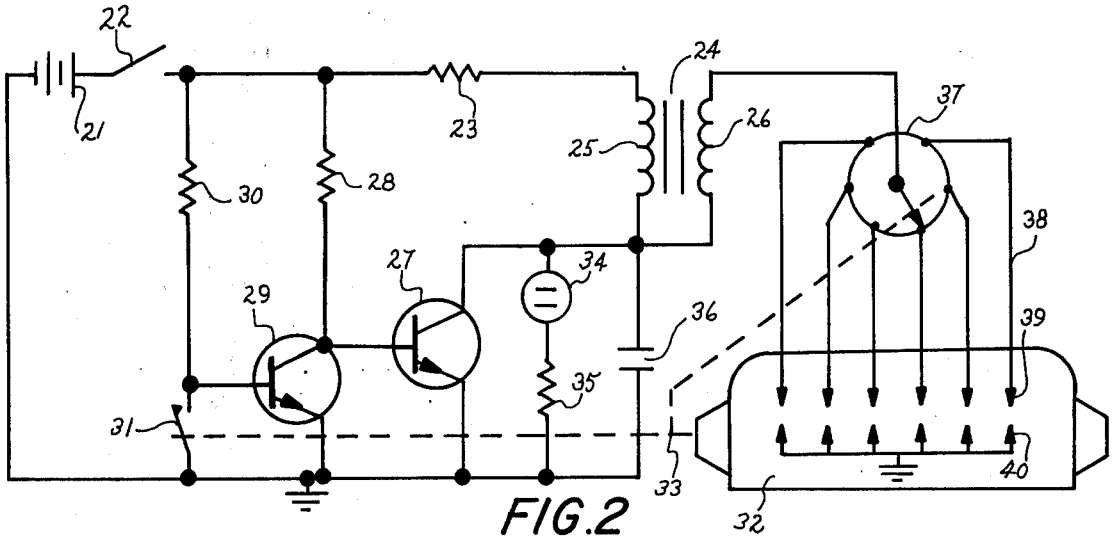
FIG. 2 is a schematic illustration of the visual indicator in an electronic switching inductive discharge ignition system.

In FIG. 2, the primary circuit is composed of battery 21, ignition switch 22, ballast resistor 23, primary winding 25 and switching transistor 27. Primary current flow is interrupted by switching transistor 27 to a non-conductive state. Driver transistor 29 is supplied base drive through base resistor 30 and produces a collector current flow through collector resistor 28. The base of transistor 29, is further connected to ground through ignition contacts 31 which are opened and closed in synchronization with engine 32 through mechanical linkage 33. When contacts 31 are closed, transistor 29 is OFF and its collector is at a positive voltage. The base of transistor 27 connected to the collector of transistor 29 is therefore also at a positive voltage, making the transistor conductive and permitting primary current to flow. When contacts 31 are opened, transistor 29 supplied base current through base resistor 30 is made conductive. The collector of transistor 29 is brought to a voltage near ground by collector current flow through collector resistor 28. The base of transistor 27 connected to the collector of transistor 29 is therefore at a voltage near ground and transistor 27 is in a non-conductive state. Primary current is therefore interrupted and by the transformer action of ignition coil 24, a H.V. ignition pulse is generated in secondary winding 26. The H.V. ignition pulse is switched by distributor 37 in synchronization with engine 32 through mechanical linkage 33 to lead 38 to spark plug 39. The pulse produces an arc from spark plug 39 to ground 40 and the gasoline mixture in the cylinder is ignited.

At the moment primary current is interrupted by the change of transistor 27 from a conductive to a non-conductive state, an overvoltage appears across the collector-emitter leads of transistor 27 because of transformer action in coil 24. Capacitor 36 connected in parallel across the collector-emitter leads acts to reduce the overvoltage by providing a low impedance path to the increasing voltage. Limit resistor 35 in series with indicator lamp 34 are also connected in parallel with the collector-emitter leads of transistor 27. The overvoltage appearing at the collector causes sufficient current to flow through lamp 34 to produce a visual indication. Each time a H.V. ignition pulse is generated, a visual indication is produced by lamp 34. The interruption of the primary current by the change of transistor 27 from a conductive to non-conductive state should be done as quickly as possible in order to generate a maximum H.V. ignition pulse in secondary winding 26. When the value of capacitor 36 is selected to produce an oscillating overvoltage across transistor 27, switching is very fast and an optimum H.V. ignition pulse is generated.

Figure 3:
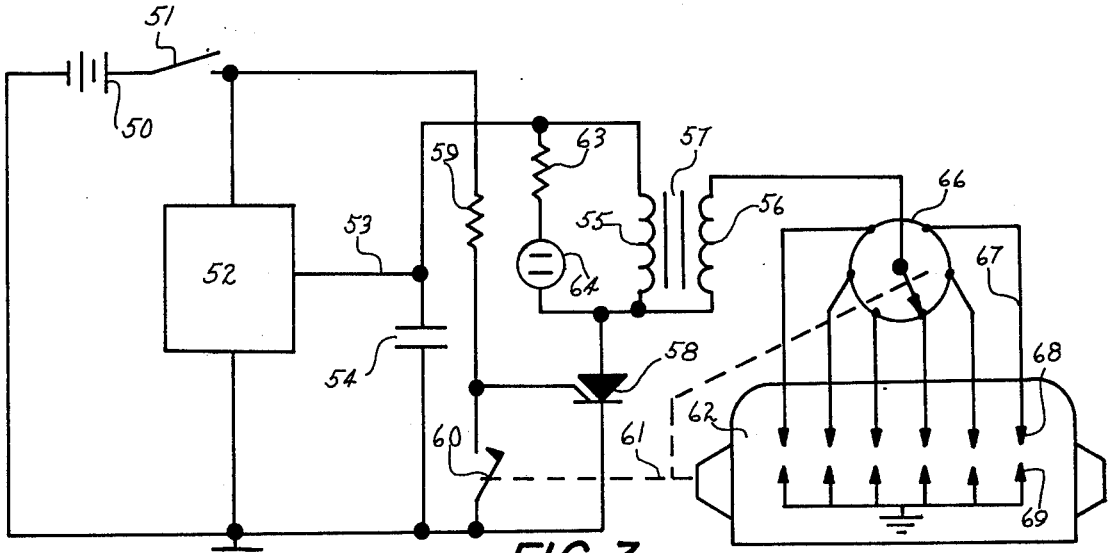
FIG. 3 is a schematic illustration of the visual indicator in a capacitive discharge ignition system.

In FIG. 3 battery 50 supplies power through ignition switch 51 to converter 52 and to the gate lead of SCR 58. Converter 52 changes the low voltage of battery 50 to a H.V. of approximately 300 volts, and is applied across storage capacitor 54 through lead 53. Also connected across capacitor 54 is primary winding 55 of ignition coil 57 in series with SCR 58. SCR 58 initiates current flow through primary winding 55 in accordance with the position of ignition contacts 60 which are driven in synchronization with engine 62 through mechanical linkage 61. Whenever SCR 58 changes from a non-conductive to a conductive state, current in primary winding is changed from zero to a pre-determined value. This change in primary coil current causes a H.V. ignition pulse to be generated in secondary winding 56. The H.V. ignition pulse is switched by distributor 66 and connected through lead 67 to spark plug 68. The H.V. pulse arcs from spark plug 68 to ground 69 and ignites the gasoline mixture. SCR 58 is made conductive by the action of ignition contacts 60 and gate resistor 59. Contacts 60 when closed ground the gate of SCR 58 and place the SCR in the non-conductive state. When contacts 60 open, the gate is supplied current from battery 50 through gate resistor 59 and SCR 58 becomes conductive. When SCR 58 becomes conductive, storage capacitor 54 discharges and the current through primary winding 55 increases abruptly and then reduces to zero as the capacitor continues to discharge. When the current reduces to near zero, SCR 58 becomes non-conductive and remains non-conductive as long as contacts 60 remain closed. Simultaneously storage capacitor 54 begins to charge to the voltage supplied by converter 52. The storage capacitor 54 becomes fully charged prior to contacts 60 opening for the generation of the next H.V. ignition pulse. The series combination of resistor 63 and indicator lamp 64 is connected in parallel with primary winding 55. When SCR 58 is in the non-conductive state no current flows in primary winding 55 and therefore no voltage appears across the primary winding and resistor 63 and lamp 64. When SCR 58 becomes conductive a large current flows through primary winding 55 and develops a voltage across the primary winding that is sufficient to provide a current through resistor 63 and lamp 64 to energize the lamp. As current through the primary winding decreases with the discharge of capacitor 54, the voltage across primary winding 55 decreases and lamp 64 is deenergized.

The application of the visual test indicator to a particular ignition system can take any of the embodiments described in detail or a combination of them. It is only necessary to connect the lamp across two points in the primary circuit where an overvoltage occurs as a result of the generation of an H.V. ignition pulse. The overvoltage may be of either polarity and the lamp may be of a type sensitive to a single polarity or non-discriminating as to polarity. A non-polar lamp in series with a diode can provide a polarity sensitive indicator. The use of a series zener diode in series with the lamp will provide a polarity sensitive indication with a threshold energization point.

Other combinations of lamps and diodes that will produce the stated results are deemed to fall within the scope of the invention.

I claim:

1. A visual indicator for an internal combustion engine ignition system comprising in combination;

a. an ignition coil having a primary winding and a secondary winding, the primary winding serially connected in a primary circuit;

b. a voltage source producing a current in the primary circuit;

c. semiconductor switching means connected in the primary circuit for changing the current in the primary circuit in synchronization with engine crankshaft rotation, the change in current producing a H.V. pulse in the secondary winding and an overvoltage in the primary circuit;

d. light emitting means connected in the primary circuit in parallel with the primary winding and energized when the overvoltage occurs in the primary circuit.

2. The system of claim 1 wherein the light emitting means limits the maximum overvoltage in the primary circuit to a pre-determined value.

3. The system of claim 1 wherein the light emitting means is responsive to the polarity of the overvoltage in the primary circuit.

4. The system of claim 1 wherein the switching means includes an SCR serially connected in the primary circuit, and the light emitting means connected in parallel across the primary winding.

5. A visual indicator for an ignition system for an internal combustion engine comprising:

a. an ignition coil having primary and secondary windings, the primary winding having first and second leads, and producing a secondary voltage whenever primary current is changed;

b. a voltage source connected to the first lead of the primary winding, and producing a primary current flow;

c. semiconductor switching means connected in series to the second lead of the primary winding and the current source, the switching means changing the primary current in synchronization with engine crankshaft rotation;

d. light emitting means connected in parallel arrangement across the primary winding, producing a visible indication whenever a voltage across the primary winding exceeds a pre-determined value.

6. The system of claim 5 wherein the switching means further includes a transistor with the collector connected to the primary winding second lead and the emitter connected to the current source, the transistor being made conductive and non-conductive by the application of a voltage to the base in synchronization with engine crankshaft rotation.

7. The system of claim 5 wherein the light emitting means further includes an ionizable gas tube connected in series with a current limiting resistor.

8. The system of claim 7 wherein the ionizable gas tube contains neon gas.

* * * * *